US011920332B2

(12) United States Patent
Cho

(10) Patent No.: US 11,920,332 B2
(45) Date of Patent: Mar. 5, 2024

(54) MALODOR REFLUX BLOCKING UNIT USING CARDIAC VALVE PRINCIPLE AND MALODOR REFLUX BLOCKING DEVICE INCLUDING THE SAME

(71) Applicant: Hyun Seung Cho, Seongnam-si (KR)

(72) Inventor: Hyun Seung Cho, Seongnam-si (KR)

( * ) Notice: Subject to any disclaimer, the term of this patent is extended or adjusted under 35 U.S.C. 154(b) by 277 days.

(21) Appl. No.: 17/483,827

(22) Filed: Sep. 24, 2021

(65) Prior Publication Data

US 2022/0381017 A1 Dec. 1, 2022

(30) Foreign Application Priority Data

May 26, 2021 (KR) ..... 10-2021-0067376

(51) Int. Cl.
*E03C 1/28* (2006.01)
*E03F 5/04* (2006.01)

(52) U.S. Cl.
CPC ..... *E03C 1/28* (2013.01); *E03F 5/0407* (2013.01); *E03F 2005/0416* (2013.01)

(58) Field of Classification Search
CPC ..... E03C 1/28; E03C 1/298; E03F 5/0407; E03F 2005/0416; E03F 5/041; E03F 2005/0417
USPC ... 4/679, 378, 584, 613, 650, 668, 671, 680; 137/247.41, 362, 577
See application file for complete search history.

(56) References Cited

U.S. PATENT DOCUMENTS

2007/0174960 A1* 8/2007 Lee ..... E03C 1/282 4/679
2013/0174921 A1* 7/2013 Schluter ..... E03F 5/0406 137/362

FOREIGN PATENT DOCUMENTS

KR 10-1147044 B1 5/2012
KR 2190972 B1 * 12/2020 ..... C02F 1/001
WO WO-2020153706 A1 * 7/2020 ..... E03C 1/281

* cited by examiner

*Primary Examiner* — Lori L Baker
(74) *Attorney, Agent, or Firm* — Revolution IP, PLLC

(57) ABSTRACT

A malodor reflux blocking unit using the cardiac valve principle, includes a space providing portion inserted into the drain pipe through the drain hole and configured to provide a drain space for the drainage, blocking portions which are, in a non-draining state, disposed to face each other and configured to block communication between the drain pipe and the drain space due to a water film phenomenon which occurs due to drainage water being present between the blocking portions, and intermediate portions configured to mediate connection between the blocking portions and the space providing portion.

8 Claims, 8 Drawing Sheets

MALODOR REFLUX BLOCKING UNIT USING CARDIAC VALVE PRINCIPLE AND MALODOR REFLUX BLOCKING DEVICE INCLUDING THE SAME

CROSS-REFERENCE TO RELATED APPLICATION

This application claims priority to and the benefit of Korean Patent Application No. 10-2021-0067376, filed on May 26, 2021, the disclosure of which is incorporated herein by reference in its entirety.

BACKGROUND

1. Field of the Invention

The present disclosure relates to a malodor reflux blocking unit using the cardiac valve principle and a malodor reflux blocking device including the same, and more particularly, to a malodor reflux blocking unit using the cardiac valve principle, which is capable of blocking reflux of a malodor or the like through a drain pipe while promptly discharging drainage water, and a malodor reflux blocking device including the same.

2. Discussion of Related Art

A drain hole is formed in a sink of a home, a hotel, or the like and in a floor surface of a bathroom, a balcony, or the like, and drainage water is discharged to the outside through the drain hole.

Such a drain hole is connected to a drain pipe, the drain pipe is finally connected to a septic tank, and the drainage water passes through the drain pipe and flows into the septic tank.

Here, the drain hole is equipped with a malodor reflux preventing device for preventing a malodor from entering the drain hole from the drain pipe. In relation thereto, Korean Patent Registration No. 10-1147044 discloses a drain trap which is lifted and lowered due to the buoyancy of water remaining in the drain hole and attached due to a magnetic force in order to block the malodor from entering an indoor space.

According to Korean Patent Registration No. 10-1147044, sewage used in a bathroom, a toilet, or the like passes through a cover of a main body of the drain trap, enters the drain hole, and then is filled in a water level retention groove. When the sewage continuously enters the drain hole, a blocking plate is separated from the drain hole and moves downward to facilitate discharge of the sewage to a sewage pipe. When the flow of the sewage into the drain hole stops, a state in which some of the sewage is filled in the water level retention groove is maintained, and here, the blocking plate moves upward due to buoyancy, and accordingly, a magnetic body on an upper surface of the blocking plate is adhered to a metal plate (or magnetic body) disposed on a bottom surface of the drain hole. In this way, the drain trap is configured to block the inflow of a smell such as a malodor coming up from the bottom (outlet) of the drain hole.

However, the conventional drain trap has a problem in that the blocking plate is not able to normally perform the lifting/lowering action when foreign substances such as hair and various types of debris that are mixed with the sewage and drained together are continuously piled up on the blocking plate and continuously accumulated inside the water level retention groove, and in this case, there is a problem in that the bottom of the drain hole cannot be blocked by the blocking plate and thus it is not possible to prevent reflux of a malodor.

SUMMARY OF THE INVENTION

The present disclosure is directed to providing a malodor reflux blocking unit using the cardiac valve principle, which is installed in a drain hole and capable of preventing reflux of a malodor while enabling discharge of drainage water, and a malodor reflux blocking device including the same.

According to the present disclosure, a malodor reflux blocking unit using the cardiac valve principle, which is a unit installed in a drain hole to block reflux of a malodor through a drain pipe while enabling drainage, includes a space providing portion inserted into the drain pipe through the drain hole and configured to provide a drain space for the drainage, blocking portions which are, in a non-draining state, disposed to face each other and configured to block communication between the drain pipe and the drain space due to a water film phenomenon which occurs due to drainage water being present between the blocking portions, and intermediate portions configured to mediate connection between the blocking portions and the space providing portion, wherein the blocking portions are radially disposed about the center of the drain space and include first blocking portions, second blocking portions, and third blocking portions which are disposed clockwise about the center along a drainage direction, the first blocking portions include a first-first blocking portion and a first-second blocking portion disposed to face each other and, in a draining state, allow the drainage water to be discharged to the drain pipe through a first discharge space provided by the first-first blocking portion and the first-second blocking portion being spaced apart from each other due to the drainage water passing through the drain space, the second blocking portions include a second-first blocking portion and a second-second blocking portion disposed to face each other and, in the draining state, allow the drainage water to be discharged to the drain pipe through a second discharge space provided by the second-first blocking portion and the second-second blocking portion being spaced apart from each other due to the drainage water passing through the drain space, the third blocking portions include a third-first blocking portion and a third-second blocking portion disposed to face each other and, in the draining state, allow the drainage water to be discharged to the drain pipe through a third discharge space provided by the third-first blocking portion and the third-second blocking portion being spaced apart from each other due to the drainage water passing through the drain space, the first-first blocking portion and the third-second blocking portion are integrally formed with each other, the first-second blocking portion and the second-first blocking portion are integrally formed with each other, the second-second blocking portion and the third-first blocking portion are integrally formed with each other, the intermediate portions include a first intermediate portion configured to connect the first-first blocking portion and the third-second blocking portion to the space providing portion, a second intermediate portion configured to connect the first-second blocking portion and the second-first blocking portion to the space providing portion, and a third intermediate portion configured to connect the second-second blocking portion and the third-first blocking portion to the space providing portion, and the malodor reflux blocking unit using the cardiac valve principle further includes closing portions which are radially disposed about the center of the drain space at ends of the first blocking portions, the second blocking portions, and the third blocking portions and configured to, in the non-draining state, close a space between the first blocking portions, a space between the second blocking portions, and a space between the third blocking portions.

In the malodor reflux blocking unit using the cardiac valve principle according to the present disclosure, the closing portions may, in the non-draining state, include a first closing portion configured to come in contact with ends of the first-first blocking portion and the first-second blocking portion, a second closing portion configured to come in contact with ends of the second-first blocking portion and the second-second blocking portion, and a third closing portion configured to come in contact with ends of the third-first blocking portion and the third-second blocking portion, and the first closing portion, the second closing portion, and the third closing portion may be integrally formed.

In the malodor reflux blocking unit using the cardiac valve principle according to the present disclosure, the first closing portion may be spaced apart from the ends of the first-first blocking portion and the first-second blocking portion in the draining state, and the second closing portion may be spaced apart from the end of the second-first blocking portion but maintain a state of being connected to the end of the second-second blocking portion in the draining state to facilitate securing of spaces for the first discharge space, the second discharge space, and the third discharge space.

In the malodor reflux blocking unit using the cardiac valve principle according to the present disclosure, the third closing portion may be spaced apart from the end of the third-second blocking portion but maintain a state of being connected to the end of the third-first blocking portion in the draining state to facilitate securing of spaces for the first discharge space, the second discharge space, and the third discharge space.

According to the present disclosure, a malodor reflux blocking device using the cardiac valve principle includes the malodor reflux blocking unit using the cardiac valve principle and a form maintaining unit inserted into the space providing portion to, when the malodor reflux blocking unit using the cardiac valve principle is installed in the drain hole, prevent the malodor reflux blocking unit using the cardiac valve principle from being sucked into the drain pipe due to the drainage water passing through the drain space.

In the malodor reflux blocking device using the cardiac valve principle according to the present disclosure, the malodor reflux blocking unit using the cardiac valve principle may further include a seating portion extending from the space providing portion and seated on a surrounding portion of the drain hole to allow the space providing portion to be disposed at a predetermined position in the drain pipe, and the form maintaining unit may include an insertion portion inserted into the space providing portion, a pressing portion extending from the insertion portion and seated on the seating portion to press the seating portion toward the surrounding portion of the drain hole, and a vortex inducing portion protruding toward the drain space to induce a vortex due to the drainage water passing through the drain space and facilitate discharge of the drainage water.

In the malodor reflux blocking device using the cardiac valve principle according to the present disclosure, the form maintaining unit may further include a connecting portion configured to connect the vortex inducing portion to at least one of the insertion portion and the pressing portion to fix a position of the vortex inducing portion at a predetermined position.

In the malodor reflux blocking device using the cardiac valve principle according to the present disclosure, the connecting portion may be spirally formed from the vortex inducing portion to facilitate a flow of the drainage water into the drain space.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
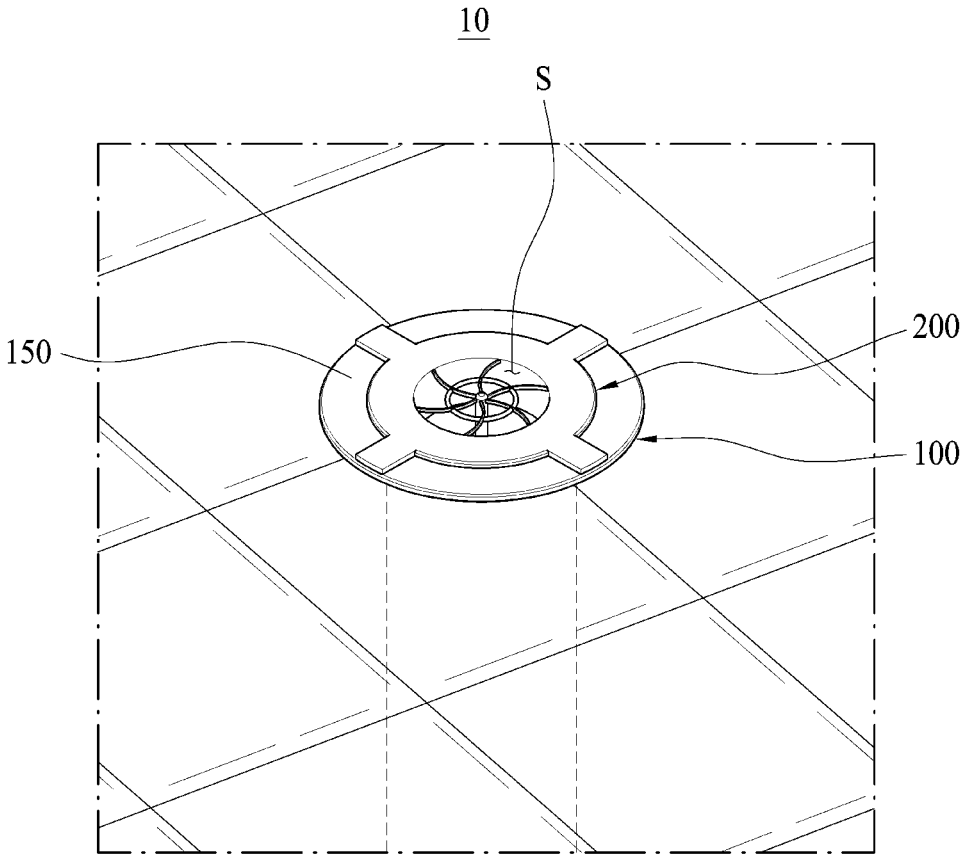
FIG. 1 is a view for describing a state in which a malodor reflux blocking device using the cardiac valve principle according to the present disclosure is installed in a drain hole and used.

Hereinafter, specific embodiments of the present disclosure will be described in detail with reference to the accompanying drawings. However, the spirit of the present disclosure is not limited to embodiments proposed herein, and those of ordinary skill in the art who understand the idea of the present disclosure may easily propose other regressive inventions or other embodiments included within the scope of the idea of the present disclosure by adding, changing, or omitting an element within the scope of the same spirit. However, these should also be construed as belonging to the scope of the spirit of the present disclosure.

In addition, like reference numerals will be used to describe like elements having the same functions within the scope of the same spirit illustrated in the drawings of each embodiment.

Figure 2:
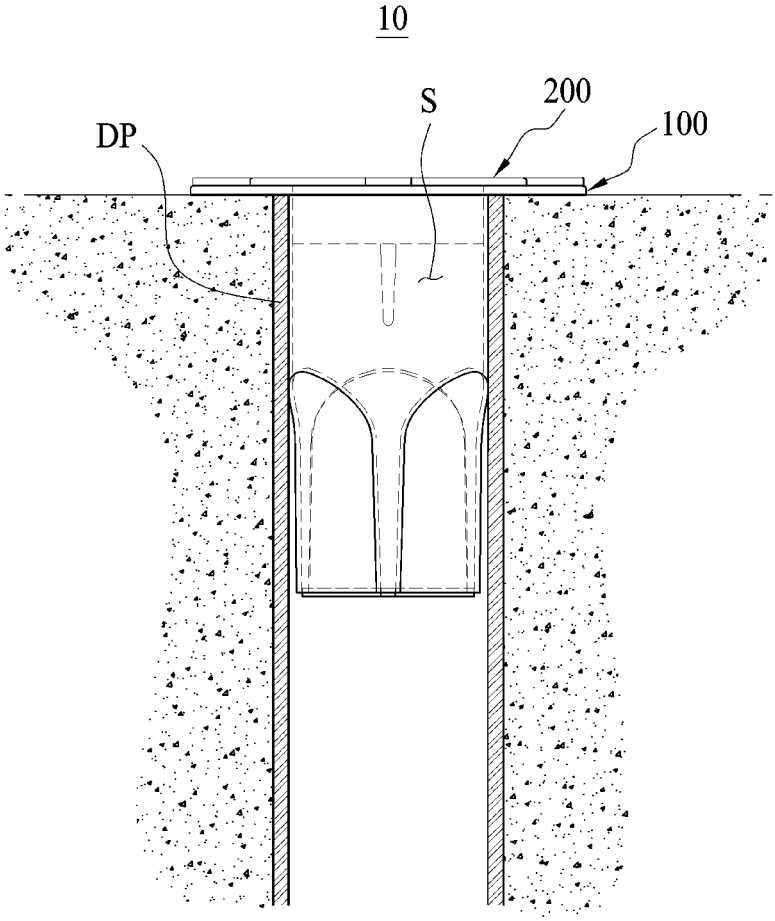
FIG. 2 is a schematic cross-sectional view for describing the malodor reflux blocking device using the cardiac valve principle according to the present disclosure.
Figure 3:
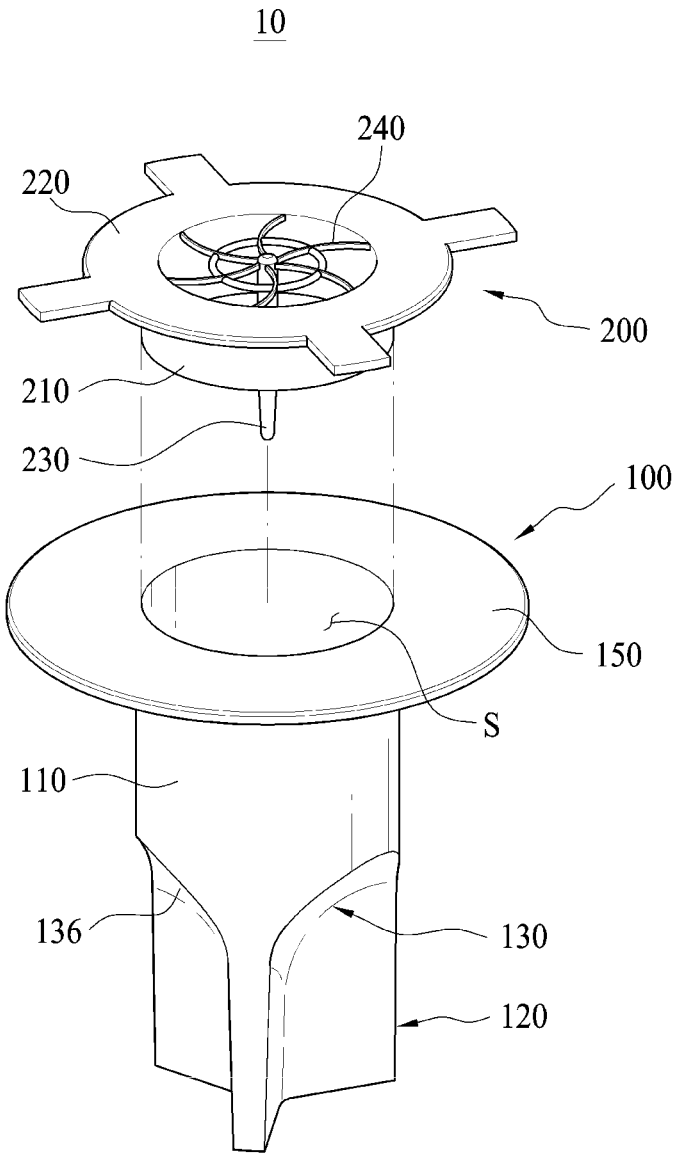
FIG. 3 is a schematic exploded perspective view for describing the malodor reflux blocking device using the cardiac valve principle according to the present disclosure.

FIG. 1 is a view for describing a state in which a malodor reflux blocking device using the cardiac valve principle according to the present disclosure is installed in a drain hole and used, FIG. 2 is a schematic cross-sectional view for describing the malodor reflux blocking device using the cardiac valve principle according to the present disclosure, and FIG. 3 is a schematic exploded perspective view for describing the malodor reflux blocking device using the cardiac valve principle according to the present disclosure.

Also, FIGS. 4 to 7 are views for describing the malodor reflux blocking device using the cardiac valve principle according to the present disclosure in a draining state.

Referring to FIGS. 1 to 7, a malodor reflux blocking device using the cardiac valve principle according to the present disclosure (hereinafter referred to as "malodor reflux blocking device 10") may include a malodor reflux blocking unit using the cardiac valve principle (hereinafter referred to as "malodor reflux blocking unit 100") installed in a drain hole to block reflux of a malodor through a drain pipe DP while enabling drainage and a form maintaining unit 200 configured to, when the malodor reflux blocking unit 100 is installed in the drain hole, prevent the malodor reflux blocking unit 100 from being sucked into the drain pipe DP due to drainage water W passing through a drain space S.

The malodor reflux blocking device 10 may be a device to which the cardiac valve principle, that is, a principle in which blood is supplied in one direction and reflux of blood is prevented, is applied.

The malodor reflux blocking device 10 may be implemented using only two elements such that the structure is simplified and the unit cost is reduced, and as illustrated in FIG. 1, installation may be completed just by inserting the malodor reflux blocking device 10 into a drain hole, and thus a reduction in construction costs may be induced due to simple installation.

Hereinafter, among the elements constituting the malodor reflux blocking device 10, the malodor reflux blocking unit 100 will be described first, and then the form maintaining unit 200 will be described in detail.

Figure 7:
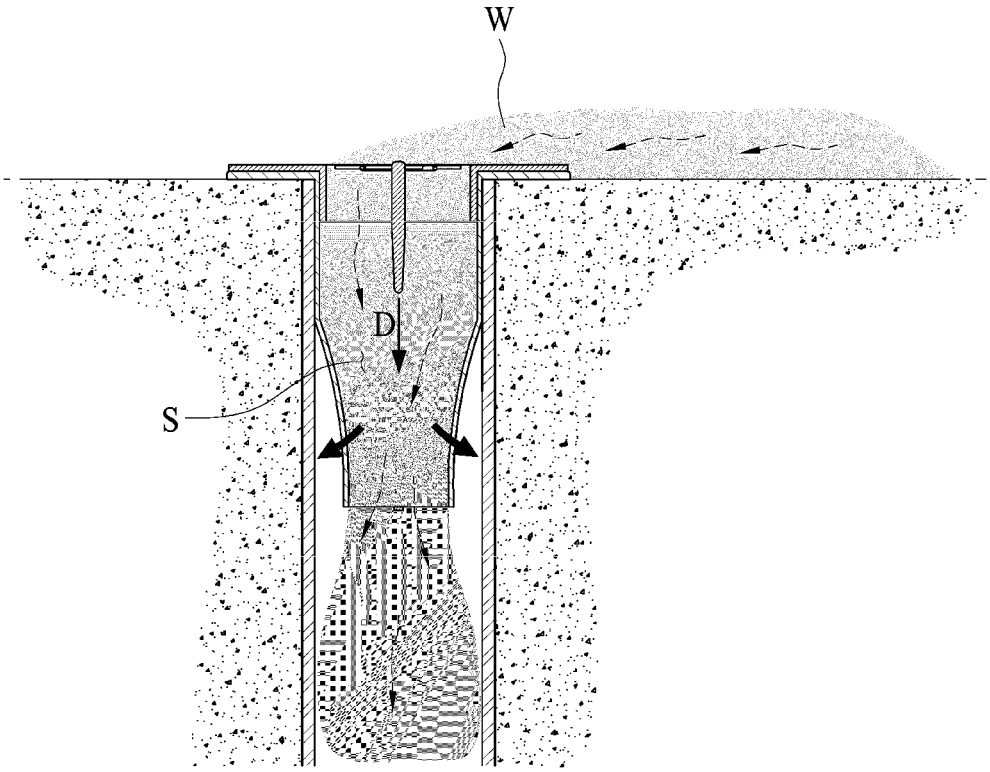

The malodor reflux blocking unit 100 may be made of a flexible and/or elastic material such as rubber and silicone, and thus, as illustrated in FIG. 7, a state of the malodor reflux blocking unit 100 may be easily changed due to an external force caused by the drainage water W.

The malodor reflux blocking unit 100 may include a space providing portion 110, blocking portions 120, intermediate portions 130, and closing portions 140.

The space providing portion 110 may be inserted into the drain pipe DP through the drain hole, may provide the drain space S for drainage, and may be implemented in a cylindrical shape of a predetermined length.

The space providing portion 110 may have an outer diameter that corresponds to an inner diameter of the drain pipe DP. Thus, an outer surface of the space providing portion 110 and an inner surface of the drain pipe DP may come in close contact with each other, and a malodor may be prevented from entering between the space providing portion 110 and the drain pipe DP.

When an error to some degree occurs in the outer diameter of the space providing portion 110 and the inner diameter of the drain pipe DP, due to the error, a small space of a predetermined size may be present between the outer surface of the space providing portion 110 and the inner surface of the drain pipe DP. However, even in this case, a seating portion 150 may come in close contact with a surrounding portion of the drain hole, and thus the small space of a predetermined size may be blocked from indoors.

The seating portion 150 may be an element radially extending from the space providing portion 110 and seated on the surrounding portion of the drain hole to allow the space providing portion 110 to be disposed at a predetermined position in the drain pipe DP.

The seating portion 150 may be substantially formed in the shape of a circular plate having a predetermined diameter, but the shape of the seating portion 150 is not necessarily limited thereto, and the seating portion 150 may also be formed in various other shapes such as a quadrangular plate shape.

The blocking portions 120 may be, in a non-draining state, disposed to face each other and configured to block communication between the drain pipe DP and the drain space S due to a water film phenomenon which occurs due to the drainage water W being present between the blocking portions 120.

The intermediate portions 130 may be elements configured to mediate connection between the blocking portions 120 and the space providing portion 110 to integrate the same.

Here, the blocking portions 120 may be radially disposed about a center C of the drain space S and include first blocking portions 122-1 and 122-2, second blocking portions 124-1 and 124-2, and third blocking portions 126-1 and 126-2 which are disposed clockwise about the center C along a drainage direction D (see FIG. 7).

The first blocking portions 122-1 and 122-2, the second blocking portions 124-1 and 124-2, and the third blocking portions 126-1 and 126-2 may be disposed at about 120° intervals about the center C but are not necessarily limited thereto.

The first blocking portions 122-1 and 122-2 may include a first-first blocking portion 122-1 and a first-second blocking portion 122-2 disposed to face each other.

Figure 6:
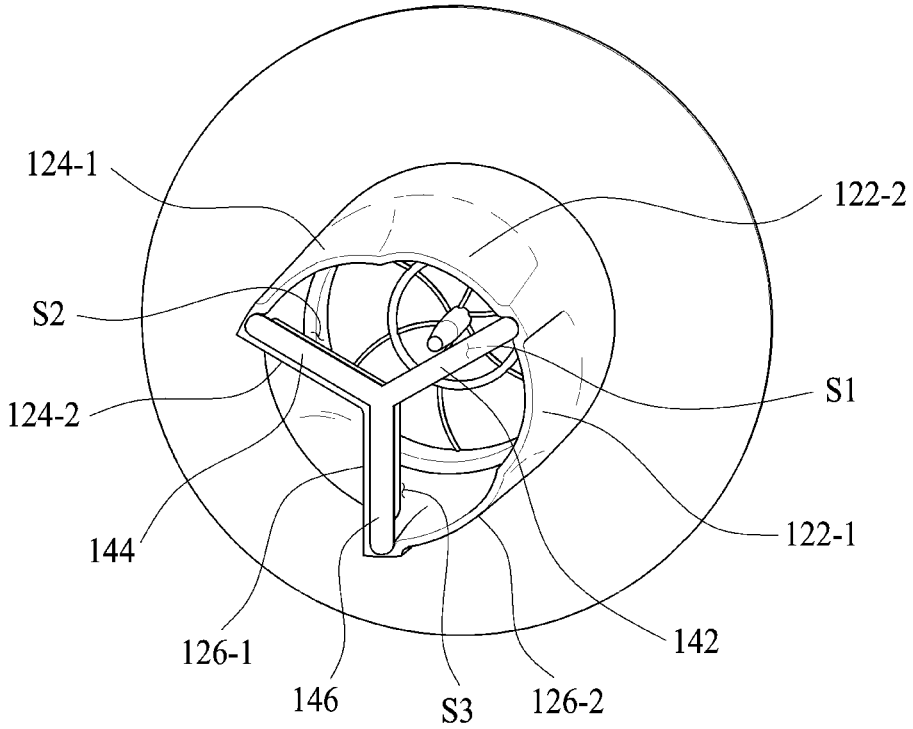

In the draining state, the first-first blocking portion 122-1 and the first-second blocking portion 122-2 may, as illustrated in FIG. 6, allow the drainage water W to be discharged to the drain pipe DP through a first discharge space S1 provided by the first-first blocking portion 122-1 and the first-second blocking portion 122-2 being spaced apart from each other due to the drainage water W passing through the drain space S.

The second blocking portions 124-1 and 124-2 may include a second-first blocking portion 124-1 and a second-second blocking portion 124-2 disposed to face each other.

In the draining state, the second-first blocking portion 124-1 and the second-second blocking portion 124-2 may, as illustrated in FIG. 6, allow the drainage water W to be discharged to the drain pipe DP through a second discharge space S2 provided by the second-first blocking portion 124-1 and the second-second blocking portion 124-2 being spaced apart from each other due to the drainage water W passing through the drain space S.

The third blocking portions 126-1 and 126-2 may include a third-first blocking portion 126-1 and a third-second blocking portion 126-2 disposed to face each other.

In the draining state, the third-first blocking portion 126-1 and the third-second blocking portion 126-2 may, as illustrated in FIG. 6, allow the drainage water W to be discharged to the drain pipe DP through a third discharge space S3 provided by the third-first blocking portion 126-1 and the third-second blocking portion 126-2 being spaced apart from each other due to the drainage water W passing through the drain space S.

Here, the first-first blocking portion 122-1 and the third-second blocking portion 126-2 may be integrally formed with each other, the first-second blocking portion 122-2 and the second-first blocking portion 124-1 may be integrally formed with each other, and the second-second blocking portion 124-2 and the third-first blocking portion 126-1 may be integrally formed with each other.

Meanwhile, the intermediate portions 130 may include a first intermediate portion 132 configured to connect the first-first blocking portion 122-1 and the third-second blocking portion 126-2 to the space providing portion 110, a second intermediate portion 134 configured to connect the first-second blocking portion 122-2 and the second-first blocking portion 124-1 to the space providing portion 110, and a third intermediate portion 136 configured to connect the second-second blocking portion 124-2 and the third-first blocking portion 126-1 to the space providing portion 110.

The closing portions 140 may be radially disposed about the center C of the drain space S at ends of the first blocking portions 122-1 and 122-2, the second blocking portions 124-1 and 124-2, and the third blocking portions 126-1 and 126-2 and configured to, in the non-draining state, close a space between the first blocking portions 122-1 and 122-2, a space between the second blocking portions 124-1 and 124-2, and a space between the third blocking portions 126-1 and 126-2.

Figure 4:
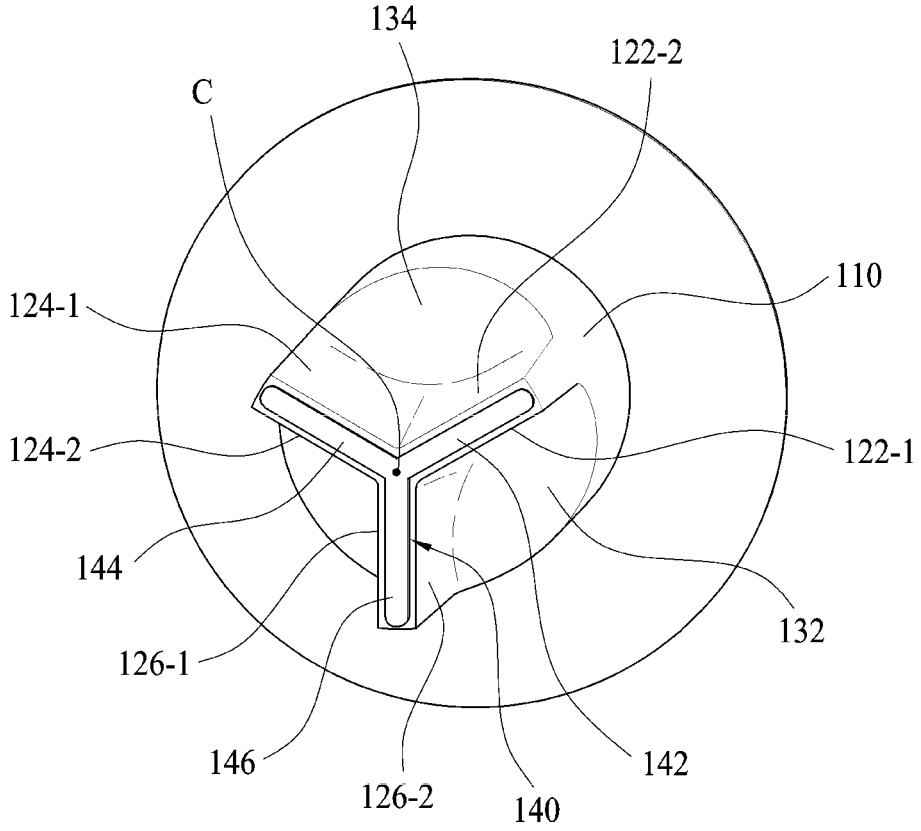
FIGS. 4 to 7 are views for describing the malodor reflux blocking device using the cardiac valve principle according to the present disclosure in a draining state.

As illustrated in FIG. 4, the closing portions 140 may, in the non-draining state, include a first closing portion 142 configured to come in contact with ends of the first-first blocking portion 122-1 and the first-second blocking portion 122-2, a second closing portion 144 configured to come in contact with ends of the second-first blocking portion 124-1 and the second-second blocking portion 124-2, and a third closing portion 146 configured to come in contact with ends of the third-first blocking portion 126-1 and the third-second blocking portion 126-2.

Here, the first closing portion 142, the second closing portion 144, and the third closing portion 146 may be integrally formed.

In the non-draining state, in the space between the first blocking portions 122-1 and 122-2, the space between the second blocking portions 124-1 and 124-2, and the space between the third blocking portions 126-1 and 126-2, reflux of a malodor from the drain pipe DP toward the drain space S may be prevented due to a water film phenomenon caused by the drainage water W being present in the spaces, and the likelihood of malodor reflux may be more effectively reduced by the closing portions 140.

Meanwhile, due to the form maintaining unit 200, the malodor reflux blocking device 10 according to the present disclosure may prevent the malodor reflux blocking unit 100 from being sucked into the drain pipe DP due to the drainage water W when the malodor reflux blocking unit 100 is installed in the drain hole.

Here, since the malodor reflux blocking unit 100 may be made of rubber or silicone that has flexibility and/or elasticity, when the malodor reflux blocking unit 100 is inserted into the drain hole and installed therein, there is a risk that the malodor reflux blocking unit 100 may be sucked into the drain pipe DP due to a change in a state of the seating portion 150 that is caused by a small external force.

However, in the present disclosure, such a problem may be prevented due to the form maintaining unit 200 being inserted into the space providing portion 110.

The form maintaining unit 200 may be made of plastic and/or stainless steel having a predetermined strength and may include an insertion portion 210, a pressing portion 220, and a vortex inducing portion 230.

The insertion portion 210 is an element inserted into the space providing portion 110 and may be formed in a cylindrical shape of a predetermined length and have an outer diameter that corresponds to an inner diameter of the space providing portion 110.

However, the outer diameter of the insertion portion 210 may also be formed to be slightly larger than the inner diameter of the space providing portion 110, and, when the insertion portion 210 is inserted into the space providing portion 110, the insertion may be implemented by forced fitting.

Of course, the space providing portion 110 may be elastically deformed when the insertion portion 210 is inserted into the space providing portion 110 by forced fitting.

The pressing portion 220 may be formed to radially extend from the insertion portion 210 and may be, when the insertion portion 210 is inserted into the space providing portion 110, seated on the seating portion 150 to press the seating portion 150 toward the surrounding portion of the drain hole.

The pressing portion 220 may be formed in a shape including a circular plate which is formed to have a predetermined diameter and a protruding plate which protrudes from the circular plate, but the shape of the pressing portion 220 is not necessarily limited thereto, and the pressing portion 220 may also be formed in various other shapes such as a quadrangular plate shape.

The vortex inducing portion 230 is an element protruding toward the drain space S to induce a vortex due to the drainage water W passing through the drain space S and facilitate discharge of the drainage water W. The vortex inducing portion 230 may be fixed at a predetermined position by a connecting portion 240.

The connecting portion 240 may connect the vortex inducing portion 230 to at least one of the insertion portion 210 and the pressing portion 220 to fix the position of the vortex inducing portion 230 at a predetermined position. The drawings illustrate an example in which the connecting portion 240 is connected to a boundary between the insertion portion 210 and the pressing portion 220.

The connecting portion 240 may be formed in various shapes that allow the drainage water W to enter the drain space S, and the vortex inducing portion 230 may be formed in a shape that protrudes from the center of the connecting portion 240 toward the drain space S.

For example, the vortex inducing portion 230 may be formed in the shape of a pin having a predetermined diameter but may also be formed in the shape of an inverted cone whose diameter decreases toward the drain space S.

Meanwhile, when the drainage water W enters the drain space S, the vortex inducing portion 230 may, in addition to performing the above-described vortex inducing function, perform a function of allowing the drainage water W to enter the center of the drain space S. Thus, the first discharge space S1, the second discharge space S2, and the third discharge space S3 may be effectively provided in the draining state, and stagnation of the drainage water W may be prevented in the draining state.

Meanwhile, the connecting portion 240 may be spirally formed from the vortex inducing portion 230 to facilitate a flow of the drainage water W into the drain space S.

Hereinafter, changes in states of the malodor reflux blocking unit 100 and the malodor reflux blocking device 10 according to the present disclosure during drainage will be described in detail.

Figure 5:
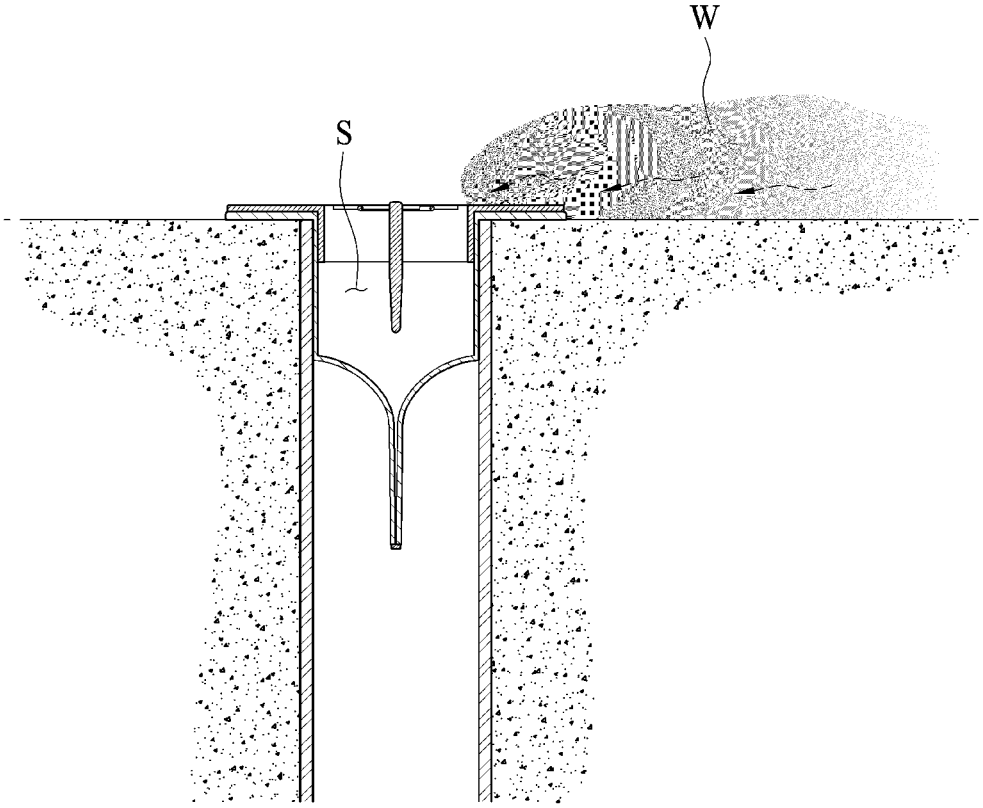

First, in the state in FIG. 4, when the drainage water W enters the drain space S as illustrated in FIG. 5, the state of the malodor reflux blocking unit 100 is changed to a state illustrated in FIGS. 6 and 7 due to the drainage water W passing through the drain space S.

Here, in the draining state, the first closing portion 142 may be spaced apart from the ends of the first-first blocking portion 122-1 and the first-second blocking portion 122-2, and the second closing portion 144 may be spaced apart from the end of the second-first blocking portion 124-1 but may maintain a state of being connected to the end of the second-second blocking portion 124-2 to facilitate securing of spaces for the first discharge space S1, the second discharge space S2, and the third discharge space S3 and improve drainage performance.

Also, in the draining state, the third closing portion 146 may be spaced apart from the end of the third-second blocking portion 126-2 but maintain a state of being connected to the end of the third-first blocking portion 126-1 to facilitate securing of spaces for the first discharge space S1, the second discharge space S2, and the third discharge space S3 and improve drainage performance.

In other words, in the draining state, when the second closing portion 144 maintains the state of being connected to the end of the second-second blocking portion 124-2 and the third closing portion 146 maintains the state of being connected to the end of the third-first blocking portion 126-1, a portion of the drainage water W passing through the drain space S that collides with an inner surface of the third intermediate portion 136 is deflected toward the first intermediate portion 132 and the second intermediate portion 134 and bounced back, and in this case, a degree to which the first-first blocking portion 122-1 and the first-second blocking portion 122-2 are spaced apart from the first closing portion 142, a degree to which the second-first blocking portion 124-1 is spaced apart from the second closing portion 144, and a degree to which the third-second blocking portion 126-2 is spaced apart from the third closing portion 146 may be maximized, and thus drainage performance may be improved.

Figure 8:
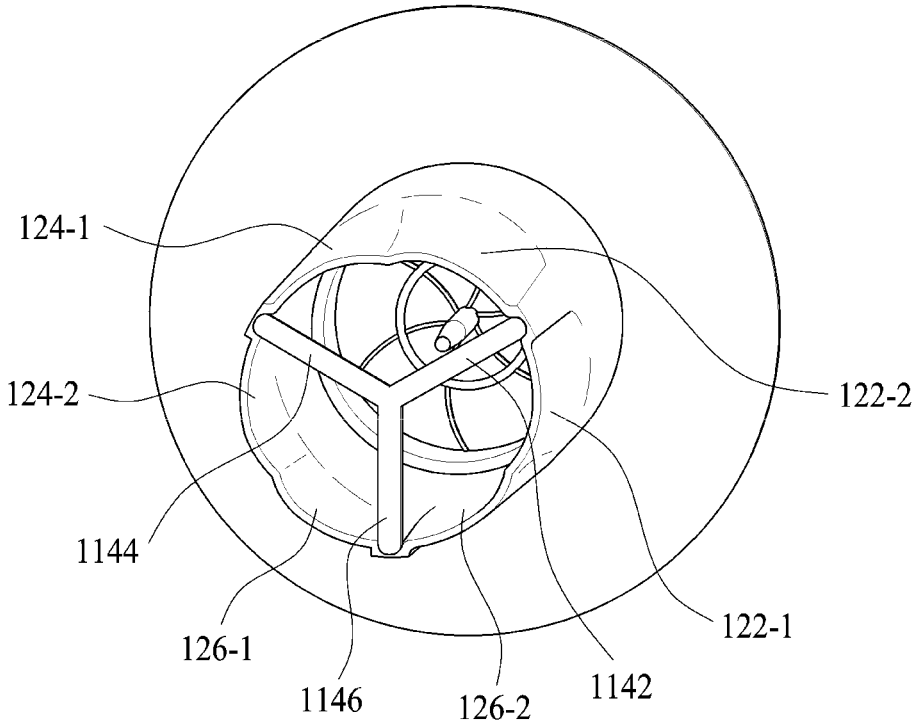
FIG. 8 is a view for describing a modified example of a malodor reflux blocking unit using the cardiac valve principle, which is provided to the malodor reflux blocking device using the cardiac valve principle according to the present disclosure, in the draining state.

FIG. 8 is a view for describing a modified example of a malodor reflux blocking unit using the cardiac valve principle, which is provided to the malodor reflux blocking device using the cardiac valve principle according to the present disclosure, in the draining state.

Referring to FIG. 8, in the draining state, a first closing portion 1142 may be spaced apart from the ends of the first-first blocking portion 122-1 and the first-second blocking portion 122-2, a second closing portion 1144 may be spaced apart from the ends of the second-first blocking portion 124-1 and the second-second blocking portion 124-2, and a closing portion 1146 may be spaced apart from the ends of the third-first blocking portion 126-1 and the third-second blocking portion 126-2.

According to a malodor reflux blocking unit using the cardiac valve principle and a malodor reflux blocking device including the same, it is possible to allow drainage water to be discharged in a draining state and prevent reflux of a malodor through a drain pipe in a non-draining state.

Also, by minimizing the number of elements for preventing reflux of a malodor, structural simplification can be implemented, and reductions in unit cost and construction costs can be induced.

The configurations and features of the present disclosure have been described above using the embodiments according to the present disclosure, but the present disclosure is not limited thereto, and it should be apparent to those of ordinary skill in the art, to which the present disclosure pertains, that various changes or modifications may be made within the idea and scope of the present disclosure. Note that such changes or modifications fall within the scope of the attached claims.

What is claimed is:

1. A malodor reflux blocking unit using the cardiac valve principle installed in a drain hole to block reflux of a malodor through a drain pipe while enabling drainage, the malodor reflux blocking unit comprising:

a space providing portion inserted into the drain pipe through the drain hole and configured to provide a drain space for the drainage;

blocking portions, in a non-draining state, disposed to face each other and configured to block communication between the drain pipe and the drain space; and intermediate portions configured to mediate connection between the blocking portions and the space providing portion, wherein the blocking portions are radially disposed about the center of the drain space and include first blocking portions, second blocking portions, and third blocking portions disposed clockwise about the center along a drainage direction, the first blocking portions include a first-first blocking portion and a first-second blocking portion disposed to face each other and, in a draining state, discharge the drainage water to the drain pipe through a first discharge space provided by the first-first blocking portion and the first-second blocking portion being spaced apart from each other due to the drainage water passing through the drain space, the second blocking portions include a second-first blocking portion and a second-second blocking portion disposed to face each other and, in the draining state, discharge the drainage water to the drain pipe through a second discharge space provided by the second-first blocking portion and the second-second blocking portion being spaced apart from each other due to the drainage water passing through the drain space, the third blocking portions include a third-first blocking portion and a third-second blocking portion disposed to face each other and, in the draining state, discharge the drainage water to the drain pipe through a third discharge space provided by the third-first blocking portion and the third-second blocking portion being spaced apart from each other due to the drainage water passing through the drain space, the first-first blocking portion and the third-second blocking portion are integrally formed with each other, the first-second blocking portion and the second-first blocking portion are integrally formed with each other, and the second-second blocking portion and the third-first blocking portion are integrally formed with each other, the intermediate portions include a first intermediate portion configured to connect the first-first blocking portion and the third-second blocking portion to the space providing portion, a second intermediate portion configured to connect the first-second blocking portion and the second-first blocking portion to the space providing portion, and a third intermediate portion configured to connect the second-second blocking portion and the third-first blocking portion to the space providing portion, and the malodor reflux blocking unit further comprises closing portions radially disposed about the center of the drain space at ends of the first blocking portions, the second blocking portions, and the third blocking portions and configured to, in the non-draining state, close the first discharge space, the second discharge space, and the third discharge space.

2. The malodor reflux blocking unit of claim 1, wherein, in the non-draining state, the closing portions include a first closing portion configured to come in contact with ends of the first-first blocking portion and the first-second blocking portion, a second closing portion configured to come in contact with ends of the second-first blocking portion and the second-second blocking portion, and a third closing portion configured to come in contact with ends of the third-first blocking portion and the third-second blocking portion, and the first closing portion, the second closing portion, and the third closing portion are integrally formed.

3. The malodor reflux blocking unit of claim 2, wherein the first closing portion is spaced apart from the ends of the first-first blocking portion and the first-second blocking portion in the draining state, and the second closing portion is spaced apart from the end of the second-first blocking portion and connected to the end of the second-second blocking portion in the draining state to facilitate securing of spaces for the first discharge space, the second discharge space, and the third discharge space.

4. The malodor reflux blocking unit of claim 3, wherein the third closing portion is spaced apart from the end of the third-second blocking portion and connected to the end of the third-first blocking portion in the draining state to facilitate securing of spaces for the first discharge space, the second discharge space, and the third discharge space.

5. A malodor reflux blocking device using the cardiac valve principle, the malodor reflux blocking device comprising:

the malodor reflux blocking unit of claim 1; and a form maintaining unit inserted into the space providing portion to, when the malodor reflux blocking unit is installed in the drain hole, prevent the malodor reflux blocking unit from being sucked into the drain pipe due to the drainage water passing through the drain space.

6. The malodor reflux blocking device of claim 5, wherein the malodor reflux blocking unit further includes a seating portion extending from the space providing portion and seated on a surrounding portion of the drain hole, and the form maintaining unit includes an insertion portion inserted into the space providing portion, a pressing portion extending from the insertion portion and seated on the seating portion to press the seating portion toward the surrounding portion of the drain hole, and a vortex inducing portion protruding toward the drain space to induce a vortex due to the drainage water passing through the drain space and facilitate discharge of the drainage water.

7. The malodor reflux blocking device of claim 6, wherein the form maintaining unit further includes a connecting portion configured to connect the vortex inducing portion to at least one of the insertion portion and the pressing portion to fix a position of the vortex inducing portion at a predetermined position.

8. The malodor reflux blocking device of claim 7, wherein the connecting portion is spirally formed from the vortex inducing portion to facilitate a flow of the drainage water into the drain space.

* * * * *